US007092646B2

(12) United States Patent
Schroath et al.

(10) Patent No.: US 7,092,646 B2
(45) Date of Patent: Aug. 15, 2006

(54) PRINTING DEVICE AND METHOD FOR LOCATING A MEDIA JAM

(75) Inventors: Leonard T. Schroath, Boise, ID (US); William I. Herrmann, Eagle, ID (US); Bruce L. Johnson, Eagle, ID (US); Bradley J. Anderson, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/426,174

(22) Filed: Apr. 28, 2003

(65) Prior Publication Data

US 2004/0213590 A1 Oct. 28, 2004

(51) Int. Cl.
*G03G 15/00* (2006.01)

(52) U.S. Cl. ..... 399/21; 399/16; 399/18; 399/76; 399/81

(58) Field of Classification Search ..... 399/16, 399/17, 21, 76, 81, 18
See application file for complete search history.

(56) References Cited

U.S. PATENT DOCUMENTS

| | | | | |
|---|---|---|---|---|
| 3,878,540 | A * | 4/1975 | Kawai | 340/530 |
| 4,572,652 | A * | 2/1986 | Tada et al. | 399/81 |
| 5,335,043 | A * | 8/1994 | Kluger et al. | 399/16 |
| 5,414,494 | A * | 5/1995 | Aikens et al. | 399/1 |
| 5,448,338 | A * | 9/1995 | Masuda et al. | 399/31 |
| 5,602,625 | A * | 2/1997 | Okamoto et al. | 399/21 |
| 5,933,677 | A * | 8/1999 | Lee | 399/20 |
| 6,075,925 | A * | 6/2000 | Downing et al. | 358/1.1 |
| 6,091,915 | A * | 7/2000 | Takagishi | 399/81 |
| 6,658,218 | B1 * | 12/2003 | Krolczyk et al. | 399/16 |
| 6,701,095 | B1 * | 3/2004 | Fujimoto et al. | 399/9 |
| 2004/0022548 | A1 * | 2/2004 | Nagaoka | 399/16 |
| 2005/0201765 | A1 * | 9/2005 | Shinga | 399/16 |

FOREIGN PATENT DOCUMENTS

JP 11334181 A * 12/1999

* cited by examiner

*Primary Examiner*—Andrew H. Hirshfeld
*Assistant Examiner*—Dave A. Ghatt

(57) ABSTRACT

A printing device is provided that includes a housing having a media path therethrough. The printing device includes at least one sensor for detecting when a media jam occurs in the media path. At least one indicator is operatively associated with a processor to provide a series of indications that can be used to locate the media jam. The indicators can comprise lights, audible indicators or graphical indicators.

29 Claims, 12 Drawing Sheets

PRINTING DEVICE AND METHOD FOR LOCATING A MEDIA JAM

FIELD OF THE INVENTION

The present invention relates to printing devices. More particularly, the present invention relates to printing devices having media jam indicators and a method of locating a media jam in a printer.

BACKGROUND OF THE INVENTION

Media jams occur occasionally in printing devices. Such printing devices can include printers, multifunction printers, copiers and the like, whether digital or analog. Typically, the media used in printing devices is print paper. Media jams are often fairly easy to detect in small, personal printing devices, but they are much more difficult to detect in larger printing devices, such as workgroup printers.

Some models of larger printers include sensors that can detect that a media jam has occurred in the media path. Often the printer control panel, or a computer associated with the printer can indicate that a paper jam has occurred. In some instances, the printer will provide a single indication of the general area of the media jam.

Often times, instructions for precisely locating the media jam may be located on the printer, such as on the inside front door of the printer. Here, diagrams may be located showing the user where printer jams typically occur. These instructions are often unclear and difficult to follow. Still further, the user may have to consult a users guide or on-line manual to obtain the diagrams showing the user where the media jams typically occur.

There may be multiple locations where jams may occur, and multiple mechanisms may exist to clear the jams from the various places. But, even following the instructions may not lead to the location of the media jam. This is because the instructions typically only lead to the general area of the media jam. Further if the media jam is located and the media is removed, in some instances small amounts of the media may become separated and remain lodged in the media path of the printer. These small amounts of media are typically difficult to locate.

Accordingly, it would be desirable to provide a printer that includes a sensor to locate the media jam and to provide indications to the user to more precisely indicate the location of the media jam.

SUMMARY OF THE INVENTION

According to one embodiment of the present invention, there is provided a method of locating a media jam in a printing device comprising detecting a media jam in a printing device. A series of indications are provided to locate the media jam.

According to another embodiment of the present invention, there is provided a printing device. The printing device comprises a housing and a media path adapted for moving a printable media through the housing. At least one sensor is operatively associated with the media path to detect the presence of jammed media in the media path. The printing device further comprises at least one indicator. The indicator is adapted to provide a series of indications to locate the jammed media.

According to another embodiment of the present invention, there is provided a printing device. The printing device comprises a housing and a media path adapted for moving a printable media through the housing. At least one sensor is operatively associated with the media path to detect the presence of jammed media in the media path. The printing device further comprises indicator means for providing a series of indications to locate the jammed media.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
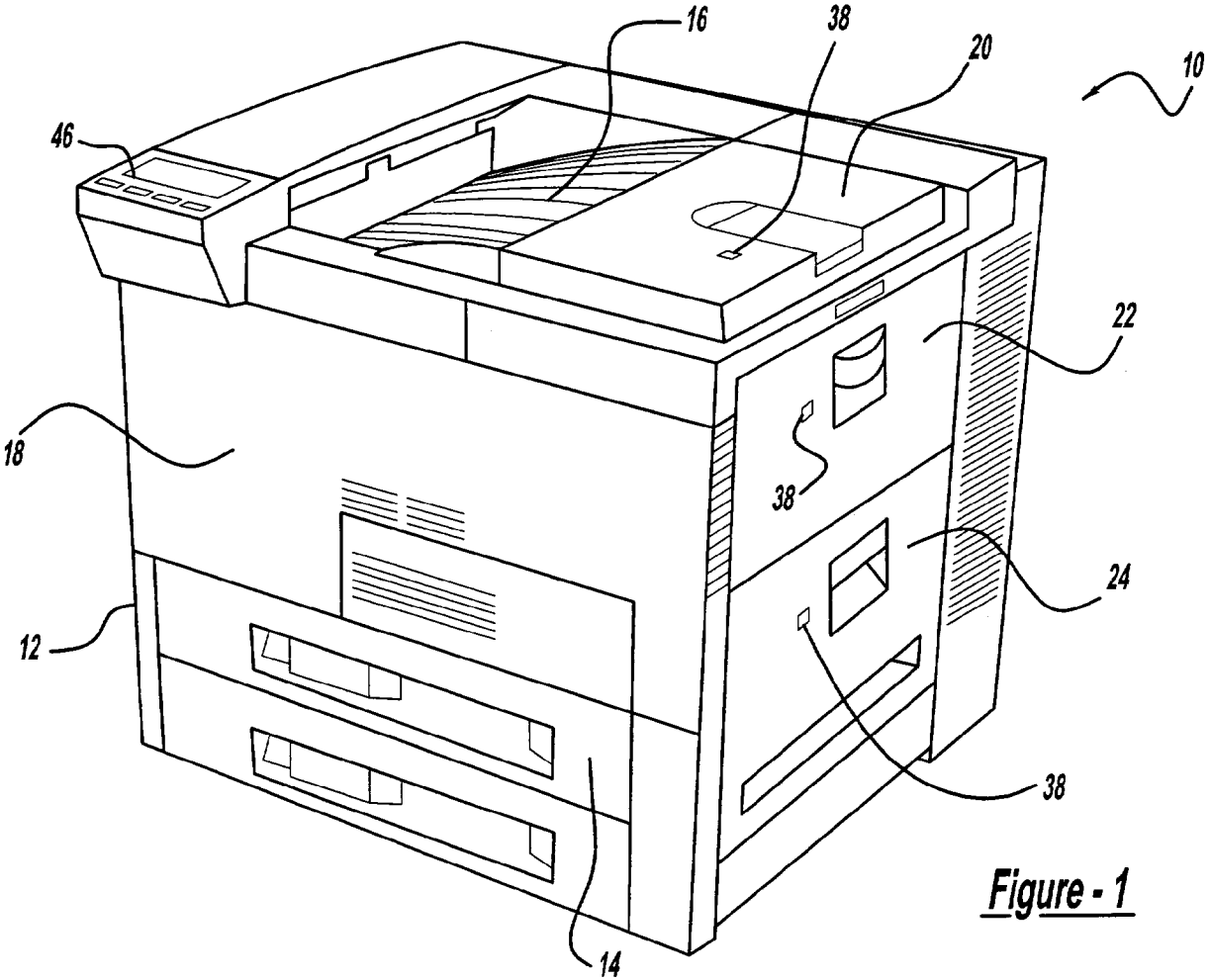
FIG. 1 shows a perspective view of an exemplary printer in accordance with one embodiment of the present invention.

FIG. 1 shows a perspective view of an exemplary printing device in accordance with one embodiment of the present invention A printer is generally shown at 10 in FIG. 1. The printer 10 shown is a LaserJet type printer. It will be appreciated however, that the printing device in accordance with the present invention can comprise any type of printing device, such as for example, but not limited to an inkjet printer, a large format printer, copier or a combination printer, scanner, copier, fax or the like, whether digital or analog. The printer 10 includes a housing 12. Typically, the printer 10 will also include at least one feed tray 14 where the media to be printed is stored and fed into the printer 10. The media often comprises paper. But it will be appreciated that the media can be any printable media, such as for example transparencies, envelopes, post cards, photo media and the like.

The printer 10 further also includes an output tray 16. The output tray 16 is for receiving the printed media. The printer 10 may also include one or more access doors 18, 20, 22, 24.

As shown in FIG. 1 four access doors 18, 20, 22, 24 are indicated. Front access door 18 allows for access to the interior of the front area of the housing 12. Top access door 20 allows access to the top area of the housing 12. Similarly, upper and lower side access doors 22, 24 allow access to different areas within the housing 12 adjacent the side thereof. Additionally, the printer includes indicators 38 and a control panel 46, as will be more fully discussed below.

Figure 2:
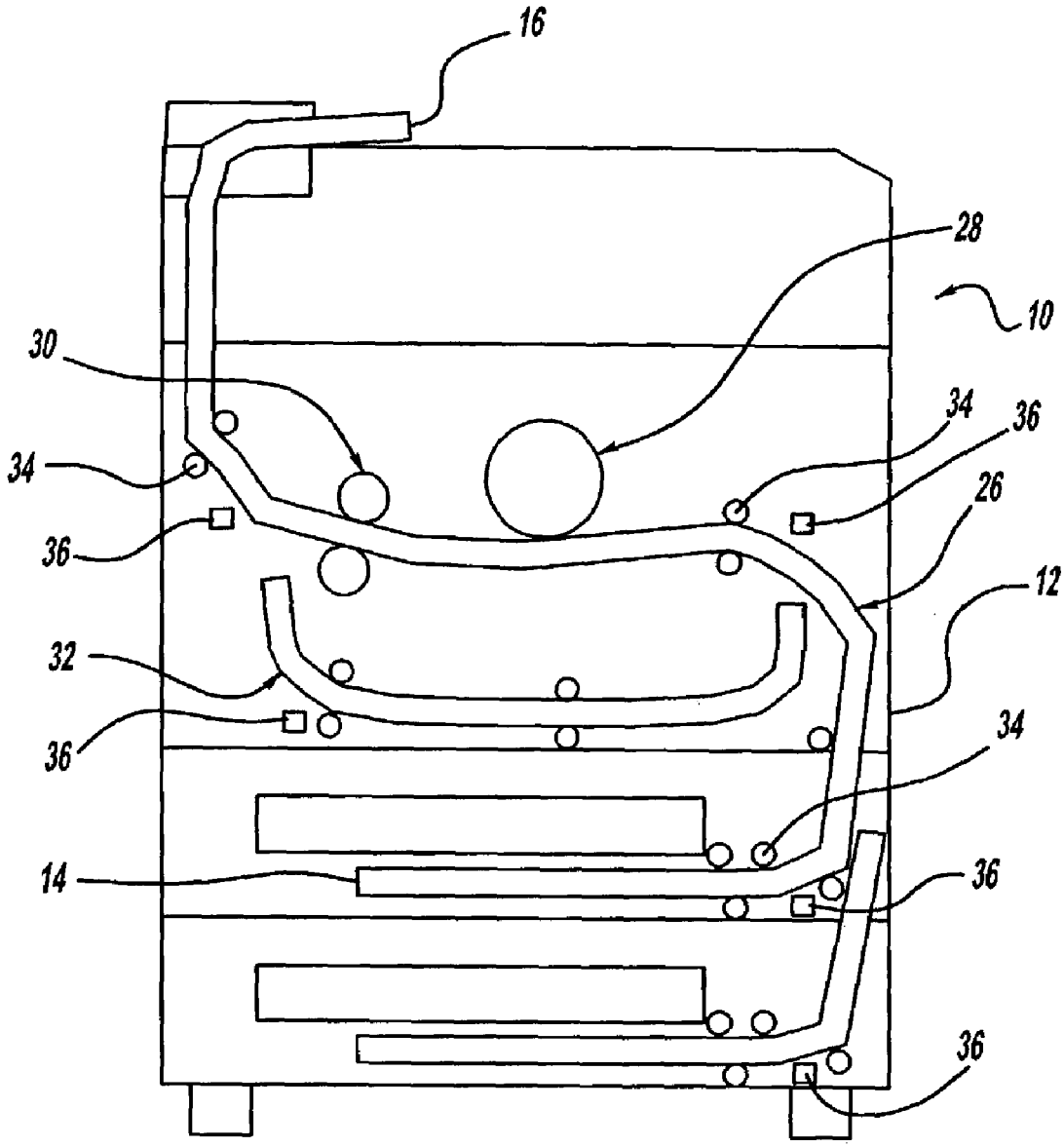
FIG. 2 shows a plan view of an exemplary media path for a printer in accordance with one embodiment of the present invention.

FIG. 2 shows a plan view of an exemplary media path for a printer in accordance with one embodiment of the present invention; More specifically, the media moves through housing along a paper path generally indicated at 26. In a typical printer, the media is fed from the feed tray 14. The media travels to a drum unit, schematically indicated at 28 in FIG. 2 where toner is applied to the paper. The media then travels to the fuser assembly, generally indicated schematically at 30 where the toner is fused to the media. From there, the media moves to the output tray 16. Some printers include an optional duplexing path, generally indicated at 32.

Several rollers 34 may also be used to move the media through the media path 26. One or more of the rollers 34 may be coupled to a drive motor (not shown) to impart movement to the roller 34. As the media travels through the media path 26 it is possible for it to become jammed. A media jam is detected by a suitable sensor 36. Many types of sensor are known for detecting media jams. Any type sensor can be used within the context of the present invention. Any number of sensors can be positioned at various locations along the media path 26. Because the media jam can occur at any location along the media path 26, it is desirable to have a more precise indication of the location of the jammed media detected by the sensor 36. Accordingly, the more locations that can be sensed by the sensors 36, the more precisely the media jam can be located. In the preferred embodiment, once a media jam is detected, a series of sequential indications as described below are provided to locate the jammed media.

Figure 3A:
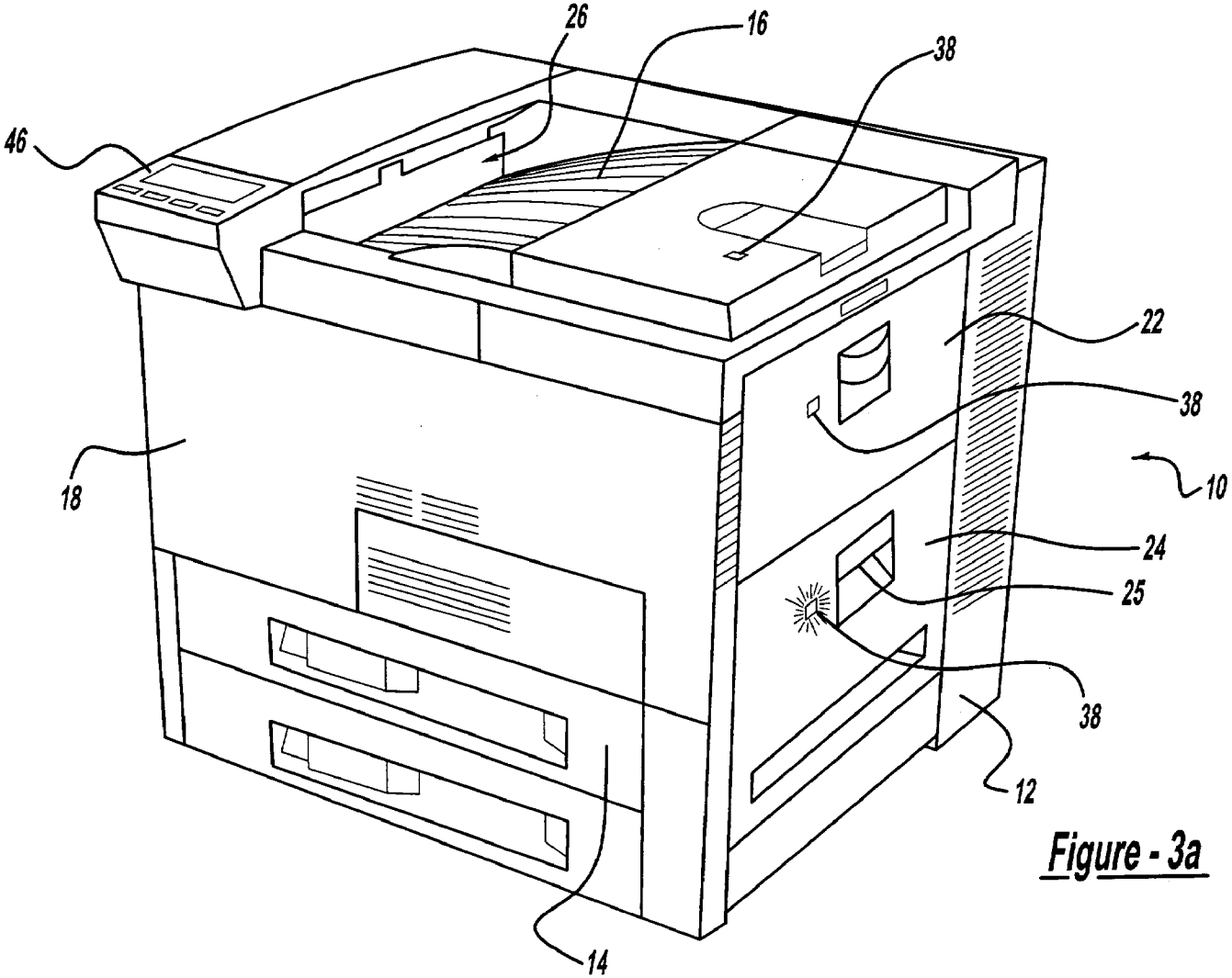
FIGS. 3*a* and 3*b* show a perspective view of the printer of FIG. 1 indicating a media jam at one location in the media path.
Figure 3B:
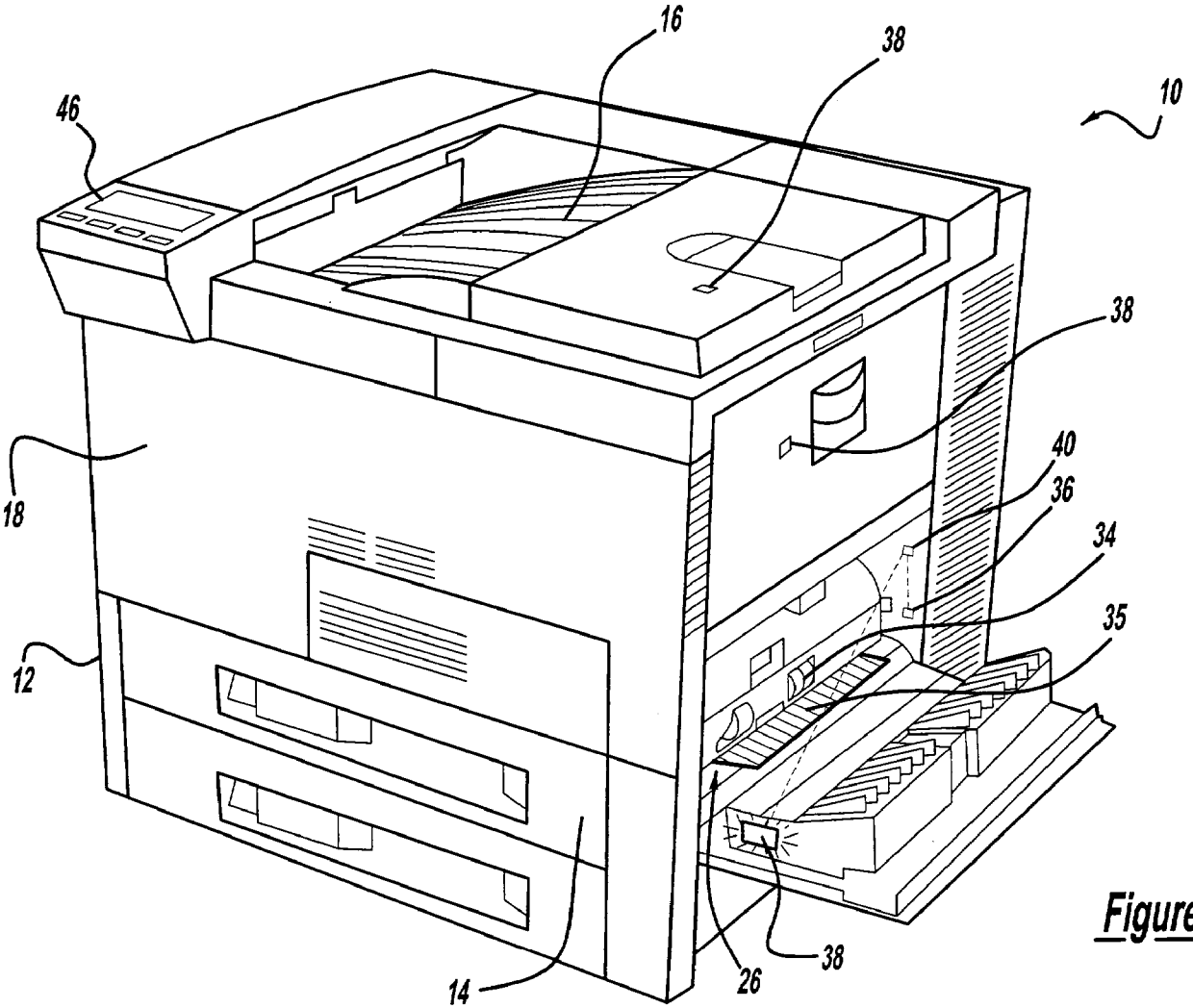
Figure 4A:
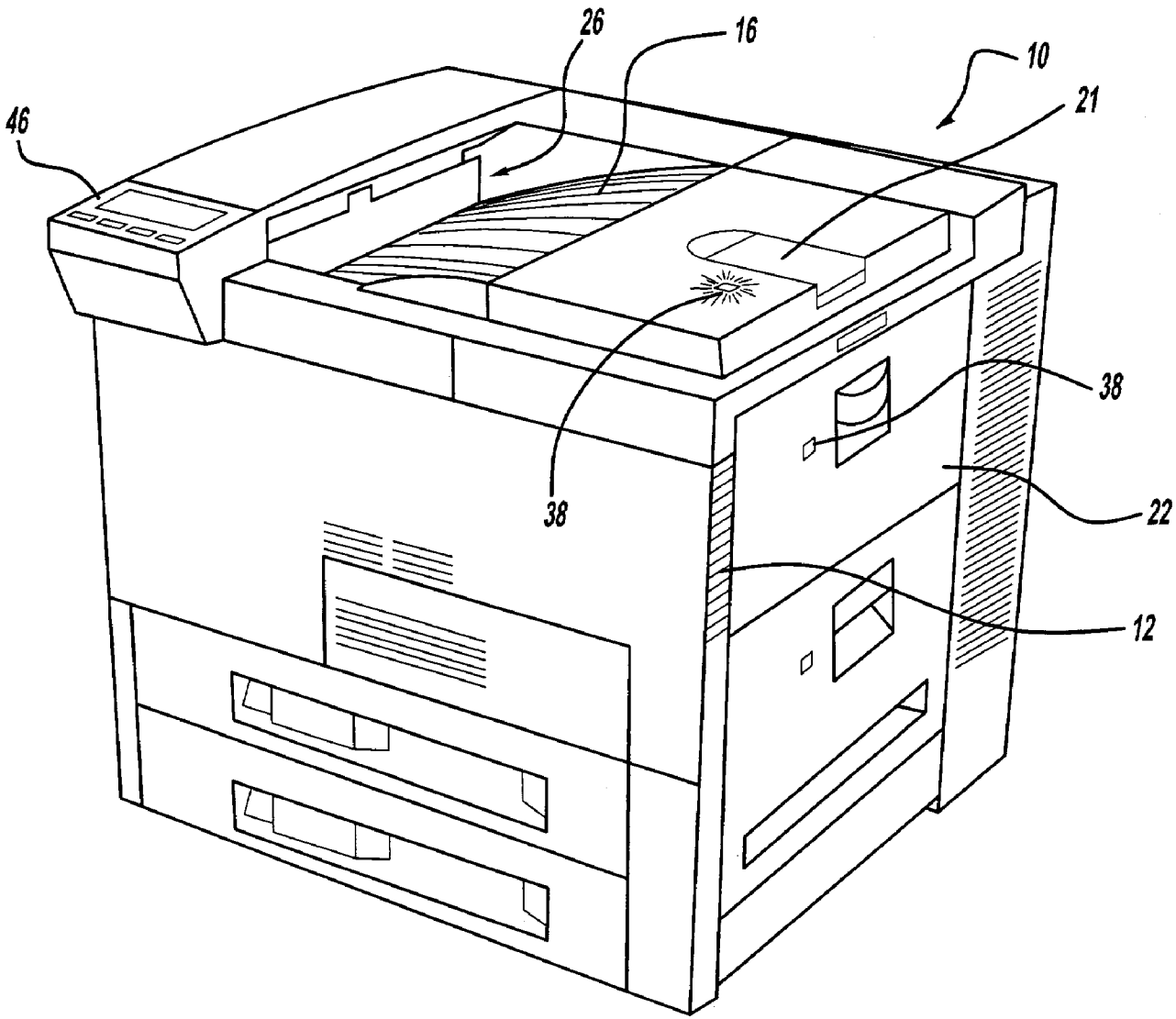
FIG. 4*a* shows a perspective view of the printer of FIG. 1 indicating a media jam at another location of the media path.

FIGS. 3*a* and 3*b* show a perspective view of the printer of FIG. 1 indicating a media jam at one location in the media path. FIG. 4*a* shows a perspective view of the printer of FIG. 1 indicating a media jam at another location of the media path. More specifically, in one embodiment of the present invention, as shown in FIGS. 3*a* and 3*b*, and FIGS. 4*a*, 4*b* and 4*c*, the printer includes a series of indicators 38 comprising lights. It is preferred that the indicator lights 38 comprise LED's. It will be appreciated, however, that within the context of the present invention, the indicators 38 can take any form, for example, a different kind of light, a tab that is popped out, an audio signal, a label, or any other suitable indicator. The indicators 38 provide a visual indication for identifying the location of the media jam detected by the sensor 36. The indicators 38 can be located adjacent a printer component that needs to be manipulated, such as a door latch 25 or a lever, or the indicators 38 can be located adjacent the printer path 26 in the areas where the media jams may occur.

A suitable processor 40, shown schematically in the FIG. 3B provides control of the indicator lights 38. The processor 40 can either be contained within the printer 10 or on a computer associated with the printer 10. It is preferred that the processor 40 be programmed to provide the necessary indications depending on the location of the media jam detected. It will be appreciated that the processors for different printers will preferably contain instructions that are specific to the given printer.

In the preferred embodiment, the indicators 38 are sequentially turned on to help the user identify the location of the jammed media. As shown in FIGS. 3*a* and 3*b*, one sequence for identifying a media jam in the feed area of the printer 10 would be as follows. Once a sensor 36 detects a media jam in the feed area of the paper path 26, the sensor 36 sends a signal to a suitable processor 40. The processor 40 then sends a signal to turn on a light 38 on the lower side access door 24 adjacent the latch 25 thereof. This would indicate to the user that the first step to be taken is to open the side access door 24 using the latch 25. Once the user opens the side access door 24, a signal is sent to the processor 40 to indicate completion of the first step necessary to clear the media jam. The processor 40 then sends a signal to turn on a second light 38 adjacent the jammed media 35. In this manner, the sequential lighting of the lights 28 indicates the steps necessary to be taken to locate the media jam, and the location of the jammed media 35 along the media path 26. Once the media jam has been cleared, the sensor 36 detects the absence of the jammed media 35 and sends a signal to the processor 40. The processor 40 in turn sends a signal to turn off each of the indicator lights it will be appreciated that the indicator lights 38 may also be turned off as the successive indicator light 38 is illuminated. In this manner, the sequential lighting of the indicator lights 38 will lead to the jam.

Figure 4B:
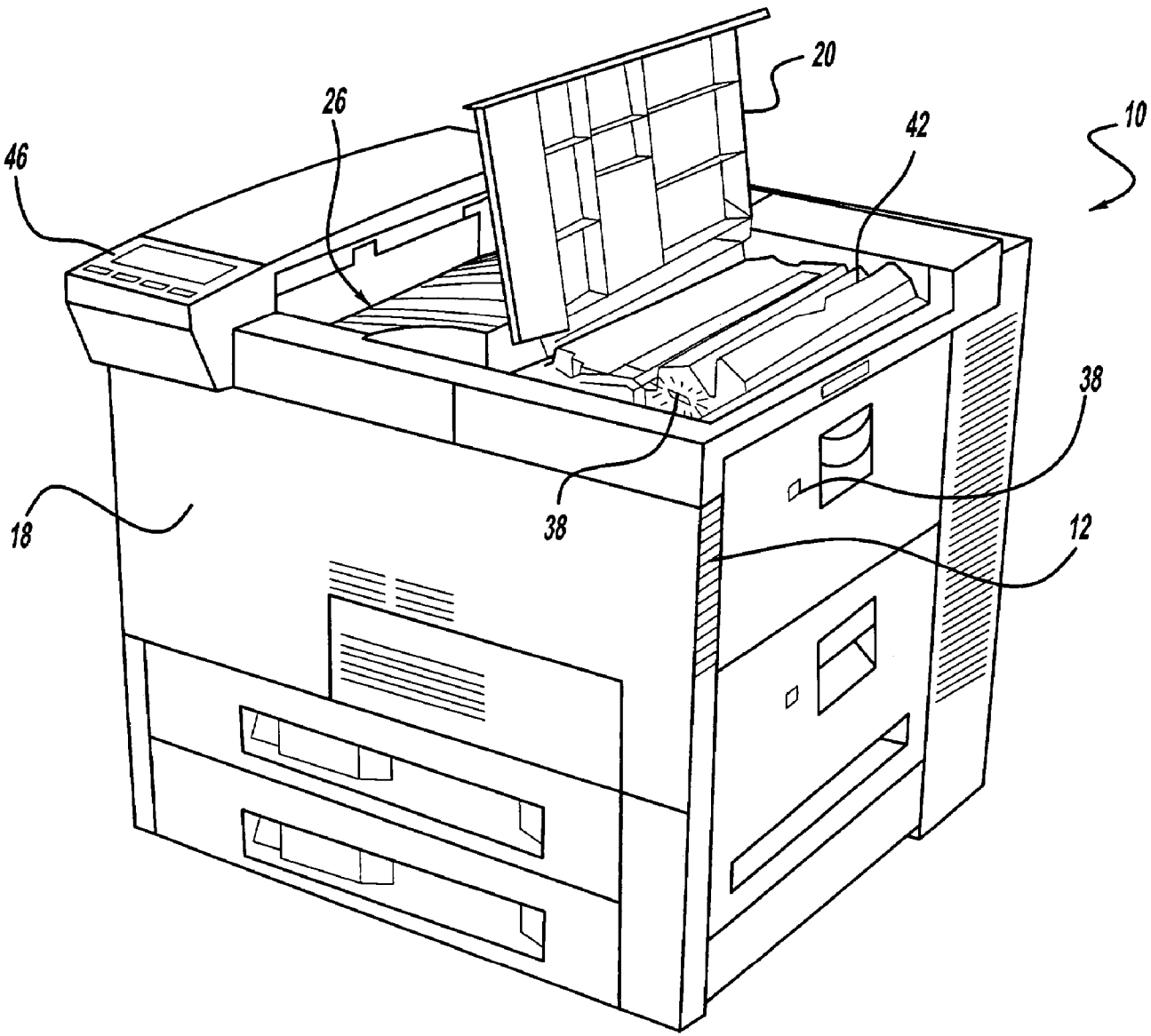
FIG. 4*b* shows a perspective view of the printer of FIG. 4*a* indicating the next successive step necessary to locate the media jam.
Figure 4C:
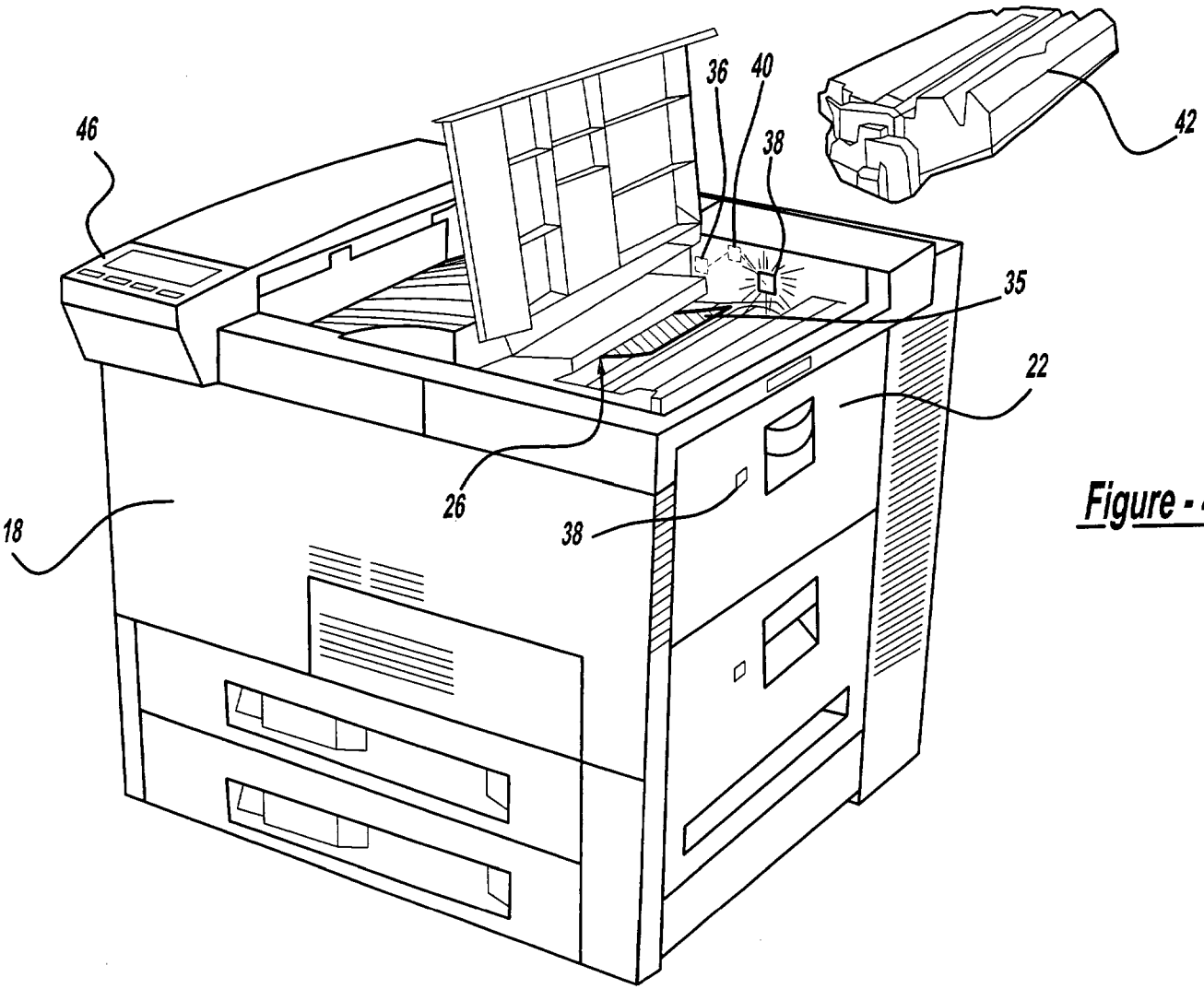
FIG. 4*c* shows a perspective, exploded view of the printer of FIG. 4*b* indicating the location of the media jam.

Another such sequence is shown in FIGS. 4*a*–4*c*. As shown in these Figures, a media jam has occurred in the drum area of the paper path 26. In this example, a sensor 36 detects the presence of a media jam. As above, a signal is sent by the sensor 36 to the processor 40 indicating the location of the media jam. The processor 40 then sends a series of sequential signals identifying the location of the media jam. In the example shown in FIGS. 4*a*–4*c*, a light 38 adjacent the top access door latch 21 latch will be lit first. Upon opening of the latch 21 by the user, the processor 40 sends a signal to light the next light 38 in the sequence. As shown in FIG. 4*b*, the light 38 adjacent a toner cartridge 42 is lit, indicating to the user to remove the toner cartridge 42. Upon removal of the toner cartridge 42, an indicator light 38 is lit to identify to the user the location of the jammed media 35. Once the media jam has been cleared, the sensor 36 detects the absence of the jammed media 35 and sends a signal to the processor 40. The processor 40 in turn sends a signal to turn off each of the indicator lights.

It will be appreciated that the processor 40 must also receive signals from suitable sensors that the required steps, such as opening of an access door, removal of a toner cartridge, etc have taken place before the next light 38 in the sequence is lit. Alternatively, once the sensor 36 has detected the location of the media jam and sent a signal to the processor 40, the processor 40 can turn on each indicator light 38 necessary to locate the media jam at one time. The lights 38 can then be followed until the media jam is located and cleared. In either case, once the media jam has been cleared, the sensor 36 detects the absence of the media jam and sends a signal to the processor 40 which, in turn, sends a signal to turn off the indicator lights 38.

In some instances, a media jam may occur at more than one location along the media path 26 at the same time. When this occurs, multiple sensors 36 will detect media jams at multiple locations and send signals to the processor 40. The processor 40 will send suitable signals to indicator lights 38 to clear a first of the media jams. Upon completion of the clearing of the first media jam, the processor 40 will send suitable signals to indicator lights 38 to clear any successive media jams. Once all media jams have been cleared all indicator lights 38 are turned off.

By utilizing the series of indicator lights 38, the printer 10 helps the user more precisely locate all media jams that may have occurred. The lights 38 indicate the successive steps necessary to locate the media jam. The lights 38 indicate which printer component must be manipulated to find the media jam. Additionally, lights 38 in the vicinity of and preferably adjacent the paper path 26, indicate the location of the jammed media 35. This allows the user to quickly identify the location of the media jam and clear it. It further aids the user in detecting multiple media jams.

Figure 5:
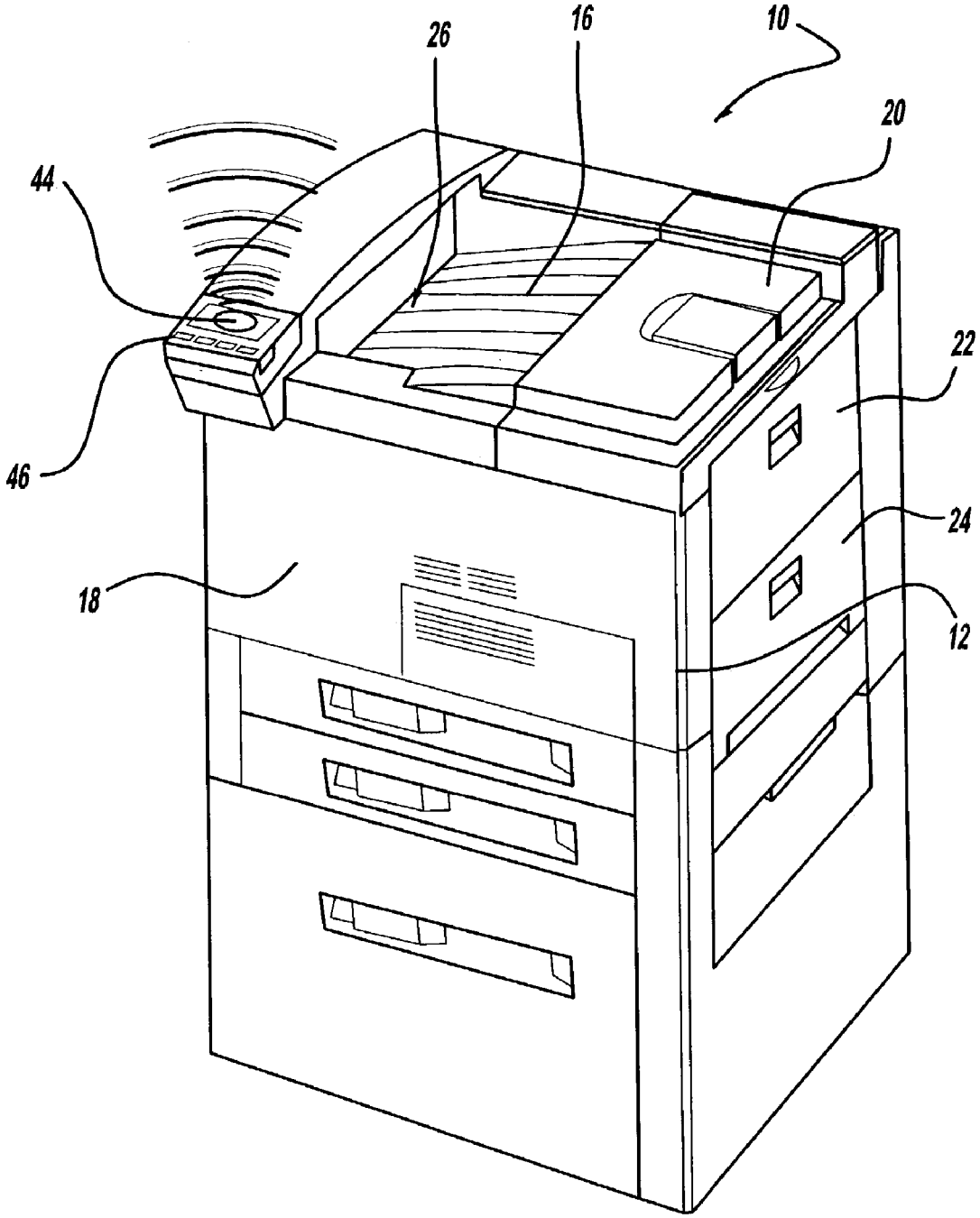
FIG. 5 shows a perspective view of a printer having an alternate audible indicator.

FIG. 5 shows an alternate embodiment where the indicator lights 38 are replaced by an audible indicator 44. Preferably the audible indicator is a speaker 44. The audible indicator 44 provides a series of audible indications or instructions that indicate the location of the media jam. More specifically, audible indications are used in place of the lights 38 of the embodiment shown in FIGS. 3 and 4.

In the FIG. 5 embodiment, the sensor 36 detects the presence of the media jam, and sends a signal to the processor 40. The processor 40 then sends a series of signals to the audible indicator 44, which gives audible instructions of how to locate the media jam. For example, if the media jam were in the drum area of the paper path, similar to that shown in FIGS. 4*a*–4*c*, the processor 40 would send a first audible signal, indicating the first step necessary to locate the media jam. For example, the audible signal may comprise the instruction, "open top access door." Upon the user opening the top access door 20, the second audible signal may then be generated by the processor 40. This signal may comprise the instruction, "remove toner cartridge." Upon removal of the toner cartridge, the processor 40 may generate a third audible signal. This signal may comprise the instruction, "remove media from the drum." In this manner a series of audible signals are sequentially provided to indicate the successive steps necessary to more precisely locate the media jam.

It will be appreciated that the audible indication can be an instruction on which printer component to manipulate to locate the media jam. Additionally, once the media jam has been located the audible indication can be an instruction on how to remove the media jam.

Figure 6A:
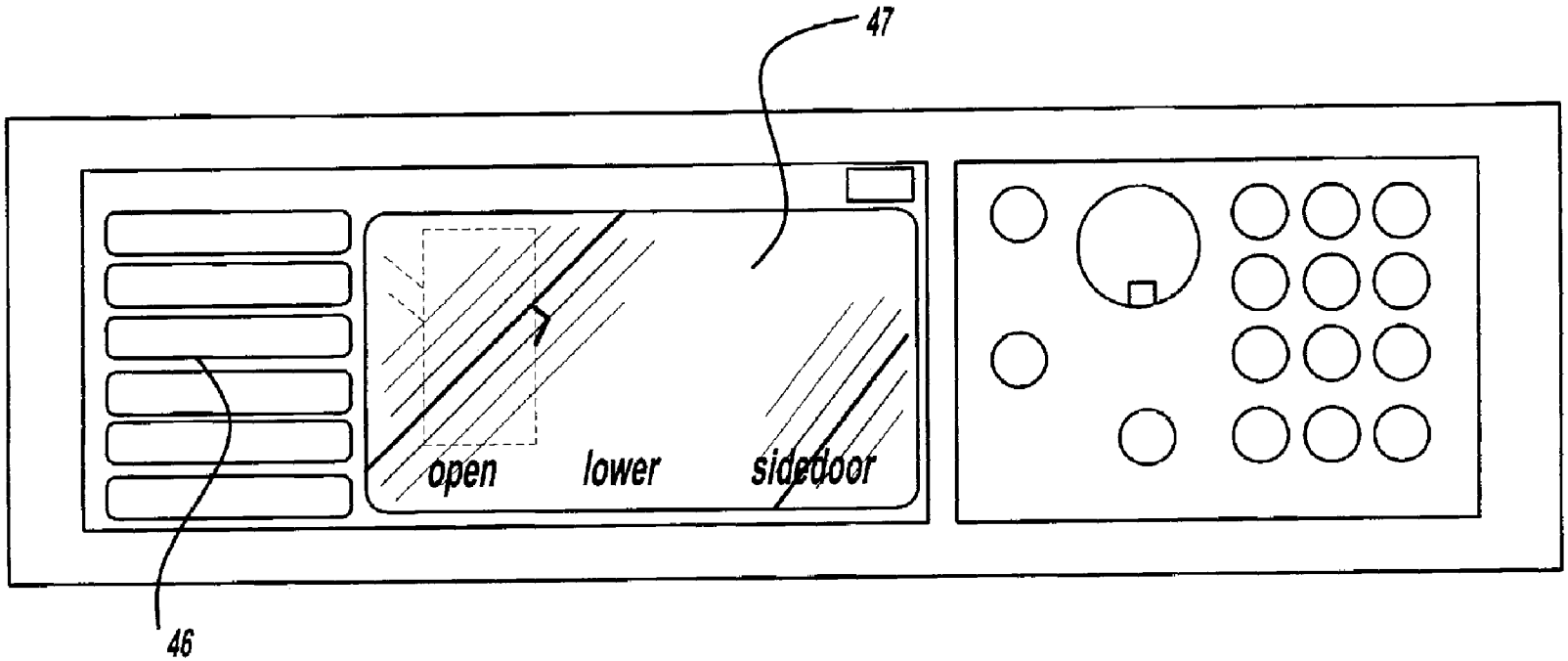
FIGS. 6*a*–6*c* show a schematic view of a control panel of a printer having an alternate graphical indicator.
Figure 6B:
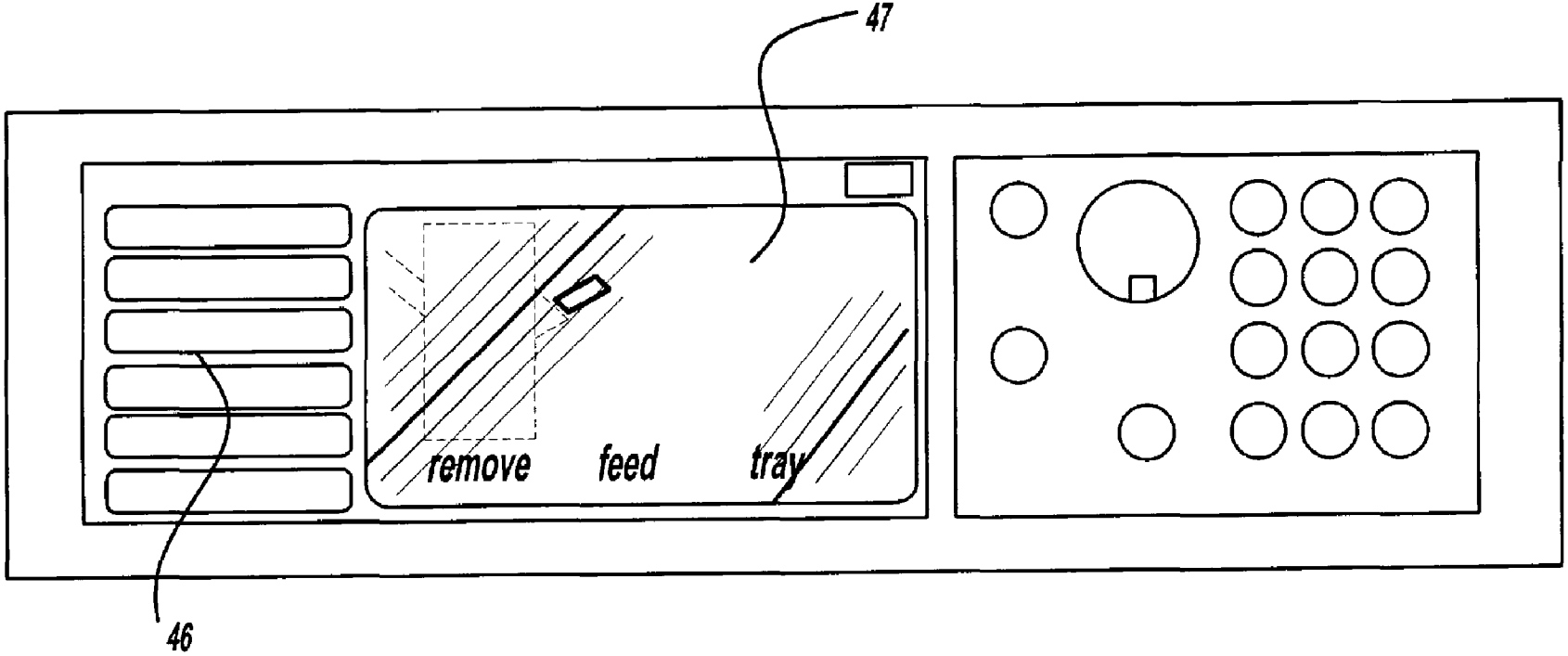
Figure 6C:
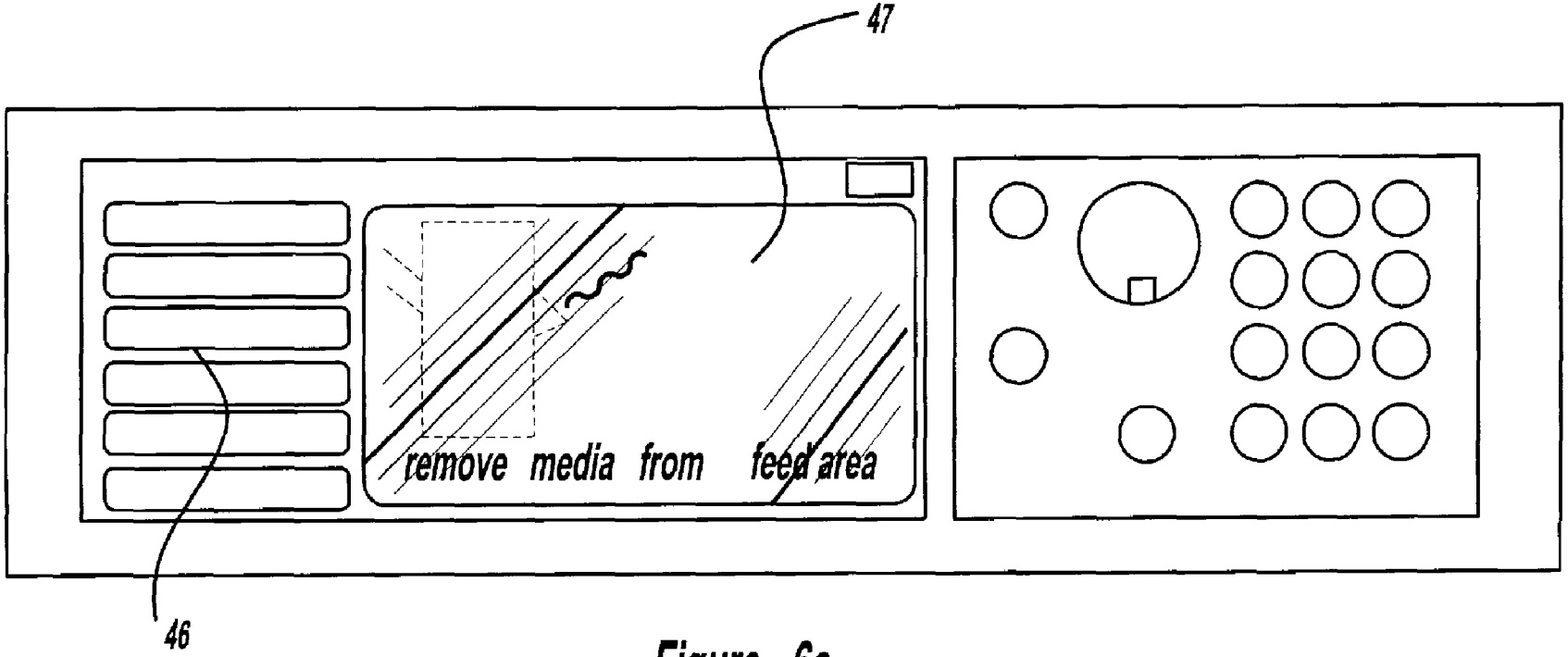

In another embodiment of the present invention the indication of the location of the media jam is graphically represented on the control panel 46 of the printer 10. FIGS. 6*a*–6*c* schematically show an alternate control panel 46 having the graphical representation. The graphical representation can be shown either by a picture or by the use of text on the screen 47 of the control panel 46, or a combination of both. The graphical representation on the control panel 46 provides a series of graphical instructions that indicate the location of the media jam. More specifically, graphical instructions are used in place of the lights 38 of the embodiment shown in FIGS. 3 and 4, and in place of the audible indicator 44 of the embodiment shown in FIG. 5.

In the FIG. 6 embodiment, the sensor 36 detects the presence of the media jam, and sends a signal to the processor 40. The processor then sends a series of signals to the graphical indicator, which gives graphical instructions in the form of pictures or text on the screen 47 of the control panel 46 of how to locate the media jam. For example, if the media jam were in the feed area of the paper path, the processor 40 would send a first graphical signal, indicating the first step necessary to locate the media jam. For example, and as shown in FIG. 6*a*, the graphical signal may comprise the instruction, "open lower side door" displayed on the screen 47 of the control panel 46. Alternatively, a picture can be displayed on the screen 47 of the control panel 46 showing the lower side access door 24 being opened. Upon the user opening the lower side access door 24, a second graphical signal may then be generated by the processor 40. This signal may comprise the instruction, "remove feed tray" displayed on the screen 47 of the control panel 46, as shown in FIG. 6*b*. Again, a picture can be displayed on the screen 47 of the control panel 46 showing the feed tray being removed. Upon removal of the feed tray by the user, a third graphical signal may be generated by the processor 40 and displayed on the screen 47 of the control panel 46. This signal may comprise the instruction, "remove media from the feed area." This is best seen in FIG. 6*c*. Alternatively, a picture showing the media being removed from the feed tray area may be displayed on the screen 47 of the control panel 46. In this manner, a series of graphical signals are sequentially displayed on the screen 47 of the control panel 46 to indicate the successive steps necessary to locate and clear the media jam. It will be appreciated that the graphical indications may comprise text messages, pictures, or combinations of both.

Figure 7:
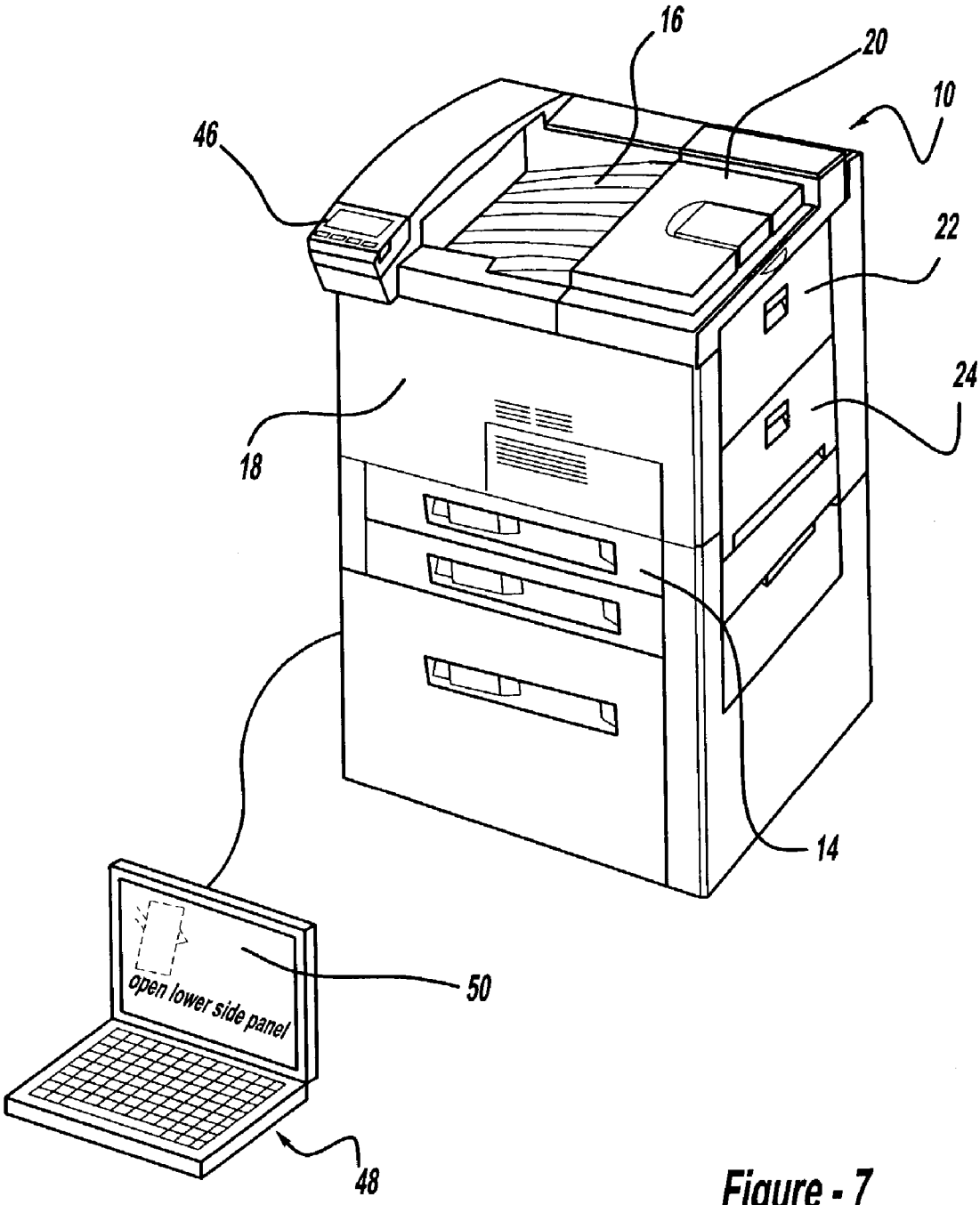
FIG. 7 shows a perspective view of a printer having another embodiment of a graphical indicator.

FIG. 7 shows an alternate embodiment having the graphical display on a computer, generally indicated at 48. More specifically, on some printers 10 the graphical indicators, screens 47, on the control panel 46 may be too small to provide the necessary graphical indications to locate the media jam. Therefore, it may be desirable to display the graphical indication on the monitor 50 of a computer 48 associated with the printer 10. The graphical indications are of the same type as those described above.

It will be appreciated that the graphical indication can be an instruction on which printer component to manipulate to locate the media jam. Additionally, once the media jam has been located the graphical indication can be an instruction on how to remove the media jam.

In use, if a media jam occurs along the paper path 26 of the printer 10, a suitable sensor 36 will detect the location of the media jam. The sensor 36 sends a signal to a processor 40, indicating the location of the media jam. The processor 40 in turn, sends a series of signals, sequentially to indicators. The indicators can comprise any or all of the lights 38, audible indicators 44 or graphical indicators on the control panel 46 of the printer or on a computer monitor 50 of a computer 48 associated with the printer 10. The indicators provide information on how to locate the media jam. If lights 38 are used, the lights 38 are lit sequentially, in response to signals from the processor 40. The lights 38 either indicate a printer component that requires manipulation, such as a door latch 21, 25, or identify the location of the media jam. Similarly, if audible indications are used, the processor 40 provides sequential signals to the speaker 44 indicating the steps necessary to locate the media jam and clear it. If graphical indications are used, the processor 40 provides sequential signals to be displayed on either the screen 47 of the control panel 46 on the printer 10 or to a computer 48 associated with the printer 10 for display on a monitor 50 indicating the steps necessary to locate the media jam and clear it.

This process is repeated until all media jams have been cleared. Once all of the media jams have been cleared, the processor 40 sends a signal to turn off all indicators. If audible or graphical indicators are used, a message indicated that the media jam has been cleared may be sent.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A method of locating a media jam in a printing device, wherein the printing device includes a control panel, comprising:

detecting a media jam in the printing device and activating a corresponding one of a plurality of indicators in response;

manipulating a user-operable component disposed in the printing device adjacent the activated indicator;

detecting the manipulation of the user-operable component and activating a different one of the plurality of indicators in response; and locating the media jam at a location adjacent the last activated one of the plurality of indicators, wherein the plurality of indicators and the user-operable components are spaced from the control panel.

2. The method of claim 1 wherein the activating comprises illuminating an indicator light.

3. The method of claim 2 wherein the indicator light is an LED.

4. The method of claim 1 wherein each indicator comprises an audible signal.

5. The method of claim 1 wherein each indicator comprises a graphical representation.

6. The method of claim 5 wherein the graphical representations are provided on the control panel.

7. The method of claim 5 wherein the graphical representations are provided on a computer operatively associated with the printing device.

8. The method of claim 1, comprising:

repeating the manipulating and the detecting for at least one additional one of the plurality of indicators and at least one additional user-operable component.

9. A printing device including a control panel, comprising:

a media path adapted for moving a printable media through the device;

at least one sensor operatively associated with the media path to detect the presence of jammed media in the media path;

a plurality of indicators disposed in the device;

a plurality of user-operable components each disposed in the device adjacent a corresponding one of the plurality of indicators, the components spaced from the control panel; and a processor arrangement configured to sequentially activate at least two of the indicators in response to the detection of the jammed media followed by the detection of manipulation of at least one of the user-operable components, the sequential activation defining an order of manipulation of the user-operable components to locate the jammed media.

10. The printing device of claim 9 wherein each indicator comprises a light.

11. The printing device of claim 10 wherein said light comprises an LED.

12. The printing device of claim 9 wherein each indicator comprises an audible signal.

13. The printing device of claim 12, wherein the audible signal is a verbal instruction.

14. The printing device of claim 9 wherein each indicator comprises a graphical indicator.

15. The printing device of claim 14 wherein said graphical indicators are displayed on said control panel of said printing device.

16. The printing device of claim 14 wherein said graphical indicators are displayed on a computer monitor of a computer associated with said printer.

17. The printing device of claim 9, wherein a first one of the at least two indicators activates in response to the detection of the jammed media, and wherein a second one of the at least two indicators activates in response to the manipulation of the user-operable component corresponding to the first one of the at least two indicators.

18. The printing device of claim 17, wherein the first one of the at least two indicators deactivates in response to the manipulation of the user-operable component corresponding to the first one of the at least two indicators.

19. The printing device of claim 18, wherein the first one of the at least two indicators remains activated until the manipulation of the user-operable component corresponding to the first one of the at least two indicators.

20. The printing device of claim 17, wherein, once activated, the at least two indicators remain activated until the jammed media has been located.

21. The printing device of claim 9, wherein a third one of the at least two indicators activates in response to the manipulation of the user-operable component corresponding to the second one of the at least two indicators.

22. The printing device of claim 9, wherein each indicator is positioned closer to the corresponding user-operable component than to any other of the user-operable components.

23. The printing device of claim 9, wherein the user-operable components include at least one of a door or a lever.

24. A printing device including a control panel, comprising:

a housing;

a media path adapted for moving a printable media through said housing;

at least one sensor operatively associated with said media path to detect the presence of jammed media in said media path; and indicator means for providing a sequence of indications to locate the jammed media, wherein said indicator means are positioned adjacent corresponding user-operable components of the printing device, wherein the components are spaced from the control panel and wherein said indicator means are configured to activate sequentially in response to the detection of the jammed media and subsequent detection of manipulation of at least one of the user-operable components, so as to define an order of manipulation of the user-operable components.

25. The printing device of claim 24 wherein said indicator means comprises a plurality of lights.

26. The printing device of claim 25 wherein said indicator means comprises a graphical indicator.

27. The printing device of claim 24 wherein said indicator means comprises an audible signal.

28. The printing device of claim 24, wherein a first indicator means activates in response to the detection of the jammed media, and wherein a second indicator means activates in response to the manipulation of the user-operable component corresponding to the first indicator means.

29. A printing device, comprising:

a media path adapted for moving a printable media through the device;

at least one sensor operatively associated with the media path to detect the presence of jammed media in the media path;

a plurality of indicators disposed in the device;

a plurality of user-operable components each disposed in the device adjacent a corresponding one of the plurality of indicators; and a processor arrangement configured to sequentially activate at least two of the indicators in response to the detection of the jammed media followed by the detection of manipulation of at least one of the user-operable components, the sequential activation defining an order of manipulation of the user-operable components to locate the jammed media.

* * * * *